United States Patent [19]

Morgan

[11] Patent Number: 4,691,964

[45] Date of Patent: Sep. 8, 1987

[54] POWERED RECLINING CHAIR

[76] Inventor: John A. Morgan, 2911 Coal Mine Rd., Newburgh, Ind. 47630

[21] Appl. No.: 880,591

[22] Filed: Jun. 30, 1986

[51] Int. Cl.[4] ..... A47C 1/02

[52] U.S. Cl. ..... 297/330; 297/76

[58] Field of Search ..... 297/330, 429, 433, 436, 297/76

[56] References Cited

U.S. PATENT DOCUMENTS

| | | | |
|---|---|---|---|
| 1,111,685 | 9/1914 | Allison | 297/436 |
| 1,564,000 | 12/1925 | Koken | 297/76 |
| 2,588,574 | 3/1952 | Rizzolo | 297/76 |
| 3,414,324 | 12/1968 | Taylor et al. | 297/330 X |
| 3,596,982 | 8/1971 | Grams | 297/330 X |
| 3,641,995 | 2/1972 | Brandt | 297/330 X |
| 3,792,905 | 2/1974 | Johnson | 297/330 |
| 3,804,460 | 4/1974 | Leffler | 297/330 |
| 3,889,998 | 6/1975 | Weiland | 297/330 X |
| 3,934,927 | 1/1976 | Zur | 297/330 X |
| 3,934,928 | 1/1976 | Johnson | 297/330 X |

*Primary Examiner*—Peter A. Aschenbrenner
*Attorney, Agent, or Firm*—Warren D. Flackbert

[57] ABSTRACT

A power reclining chair positionable by the operation of independent electric motors to which the leg portion, the seat portion and the back portion of the chair are each selectively responsive movement-wise. The leg portion is characterized by an extendable foot section which is movable from a normal position to an in-line position with respect to the longitudinal direction of the leg portion, and conversely. The instant power reclining chair may assume a variety of use positions, as, for example, an upright or sitting position; comfort, as reclining, positions; and, a substantially flat position.

4 Claims, 3 Drawing Figures

POWERED RECLINING CHAIR

As is known, the popularity of reclining chairs is widespread, where such currently marketed are usually hand-controlled for movement to a variety of user positions. In other words, and as to the latter, the conventional chair may be movable from a sitting position to a reclining position, with the leg support of such moving, at the same time, through a range of positions, depending upon user control. Reclining chairs are desirable for home or residential use, as in connection with television watching, for example, and extend to and/or include convalescent usage, either at home or in an institution.

The invention presents a reclining chair which is power operated to and from any number of user positions, and includes a seat portion, a leg portion and a back portion. Each of the aforesaid portions is selectively and individually movable to satisfy a user's need, use or comfort-wise, including one which accommodates a particular convalescent purpose. The leg portion of the invention is arranged to permit ready and positive movement of a foot receiving section thereof from an in-line position to a normal position, and conversely, through provision of a simple operating mechanism.

In a preferred embodiment, the powered reclining chair of the invention may be on wheels to achieve ready movement from one location to another, a feature particularly useful in the event the chair is employed at a health care site.

Figure 1:
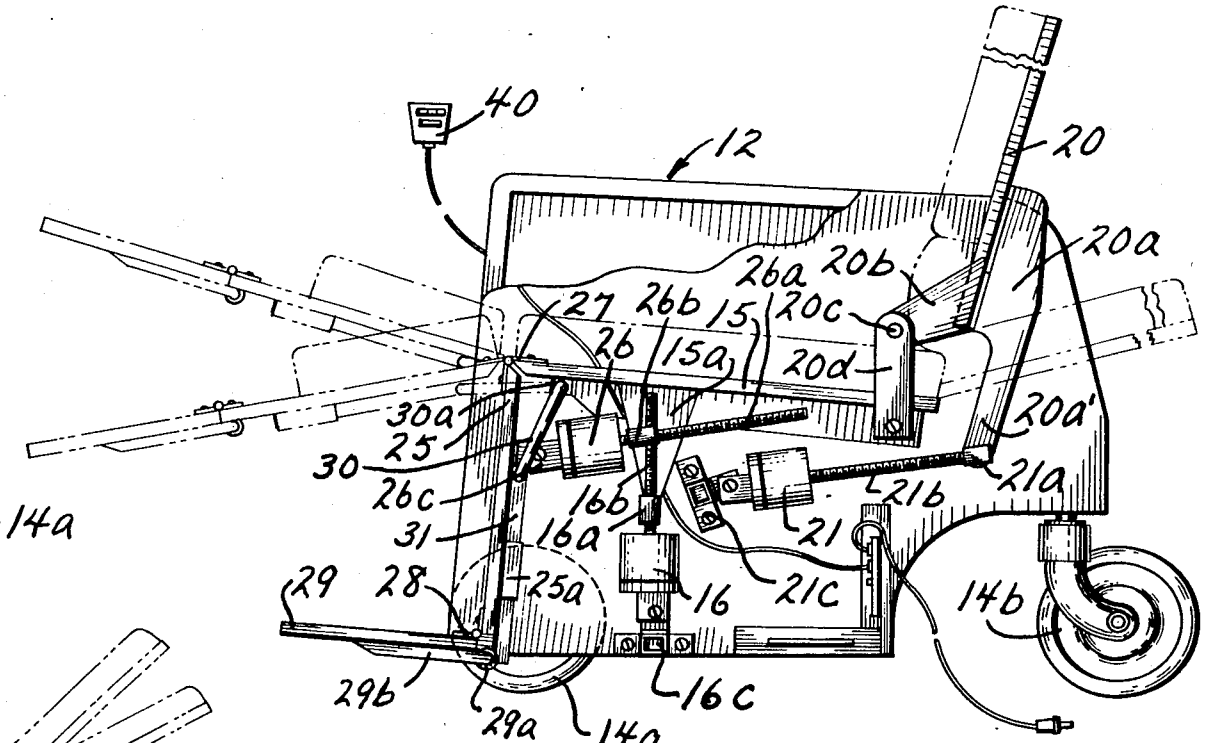
Figure 2:
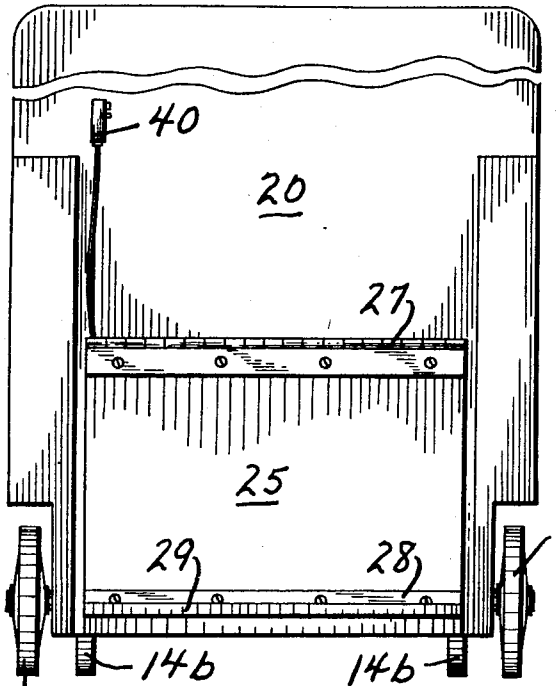
Figure 3:
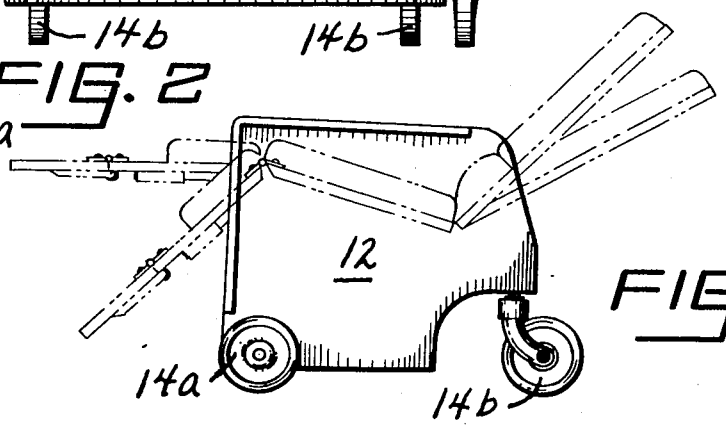

In any event, a better understanding of the present invention will become more apparent from the following description, taken in conjunction with the accompanying drawing, wherein FIG. 1 is a view in side elevation showing a powered reclining chair in accordance with the teachings of the present invention, with a phantom line showing of portions of the chair at various use positions;

FIG. 2 is a view in front elevation of the powered reclining chair of FIG. 1, looking from left to right in such figure; and, FIG. 3 is a view in side elevation illustrating the portions of the chair, in phantom, at various other use positions.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the powered reclining chair of the invention is defined by a body or framework 12 typically supported by fixed wheels 14*a* and pivotal wheels 14*b*, the former being positioned at the front of the framework 12 and the latter at the rear of the framework 12. The framework 12 further includes a cushion (shown in phantom) receiving seat portion 15, back portion 20, and leg portion 25, where each of the preceding are independently powered for selective positional placement by electric motors 16, 21 and 26, respectively. The latter are operated by a hand control 40 which is typically located at a position affording ready access by the user.

As to back portion 20, and with particular reference to FIG. 1, a mounting assembly 20*a* is secured to the rear surface thereof, where bracing 20*b*, at either side, extends forwardly and pivotally engages, at 20*c*, brackets 20*d* secured to the undersurface of seat portion 15. Downwardly extending arms 20*a'* forming part of the mounting assembly 20*a* operatively connect to a nut 21*a* movable along a screw 21*b*, typically acme threaded, when the latter is rotated upon energization of motor 21. As evident, motor 21 is positioned by a bracket 21*c* secured to framework 12. In any event, rotation of bracing 20*b*, at 20*c*, achieves movement of the back portion 20, with the latter assuming various use positions (also see FIG. 3).

Again referring to FIG. 1, and now with respect to the seat portion 15 (which pivots on pins—not shown —which extend laterally from the sides of the framework 12 proximate the rear thereof), the latter includes bracing 15*a* extending downwardly from the undersurface thereof and operatively connecting nut 16*a* movable along a screw 16*b* (also typically acme threaded) when motor 16, positioned by bracket 16*c* on framework 12, is energized, selectively achieving upward and downward, including pivoting and/or angling movement of the bracing 15*a*, and, hence, the seat portion 15 (again see FIG. 3).

The leg portion 25 is hingedly connected to the seat portion 15, at 27 (see FIG. 2), and includes an extendable foot receiving or support section 29 which is selectively movable from a normal position with respect to the longitudinal direction of the leg portion 25, as shown in FIG. 1, to an in-line position therewith (see the broken line showings in FIG. 1). As evident, the extendable foot support section 29 and the leg portion 25 are assembled together at hinge 28, where overall operation is controlled by a screw 26*a* (again, typically, acme threaded) rotatably responsive to energization of motor 26.

In this connection, a nut 26*b*, through which the screw 26*a* passes, is secured to bracing 15*a* (not detailed). Screw 26*a*, by either a pushing and/or withdrawing movement due to operation of motor 26 (where the latter is secured, by a bracket 26*c*, to the rear of leg portion 25), achieves the desired leg portion 25 positioning.

As evident in FIG. 1, control arms 30 cooperatively interconnect tabs 30*a* depending from the undersurface of the seat portion 15 and links 31 slidable through housings 25*a* disposed on either side of the rear surface of the leg portion 25. As leg portion 25 is caused to move outwardly by reason of motor 26 operation, control arms 30 permit withdrawal of the links 31 from the position of FIG. 1, allowing movement, by gravity, of the extendable foot support section 29 into the in-line positions shown by the broken lines in FIG. 1.

The converse is true when the leg portion 25 is returned to the position of FIG. 1, where, in this instance, the extendable foot support section 29 rotates to an outwardly normal relationship therewith by reason of movement of links 31. The latter is achieved through the provision of rollers 29*a* on framework 29*b* beneath the foot support section 29, against which links 31 present a thrust for achieving the desired rotation at hinge 28.

Restated in another manner, by virtue of extending leg portion 25, links 31 are retracted by control arms 30, allowing foot support section 29 and framework 29*b* to fall by gravity (and the natural weight of the user's feet), with rollers 29*a* allowing a smoother operation for the preceding.

In other words, electric motors 16, 21 and 26 operatively connecting foot portion 15, back portion 20 and leg portion 25, respectively, cause the reclining chair herein to assume various user positions, as those illustrated in both FIGS. 1 and 3. Such positions are representative of, for example, an upright or sitting position; comfort positions, i.e. reclining, where the user's feet might be higher than the user's head; and, a substantially flat position. The powered reclining chair of the invention is, therefore, versatile in end results.

As to the electrical circuitry (not detailed herein), control 40 typically operates a relay (after voltage reduction to 12 volts) which, in turn, actuates the desired motor 16, 21 and 26. Control 40 may include toggle switches for ease in the described chair positioning, where a printed circuit board (also not detailed) may be provided.

It should be evident from the preceding that the powered reclining chair presented herein affords important user features, where such, as described, are susceptible to various changes within the spirit of the invention as, for example, in proportioning; precise component location and mounting; the form of powering; and, the like. Thus, the preceding should be considered illustrative and not as limiting the scope of the following claims.

I claim:

1. A powered reclining chair comprising a framework mounting a seat portion, a back portion and a leg portion, and independent electrical motors operatively connecting each of said portions in a selective positioning relationship, where said leg portion includes a foot section pivotal to and from a normal and an in-line position with respect to the longitudinal direction of said leg portion, and where said pivotal movement of said foot section is accomplished by structure including a hinge connecting said leg portion and said foot portion, a support member disposed on the rear surface of said leg portion, a control member slidable on said support member in response to pivotal movement of said leg portion from a first position maintaining said foot section in a normal relationship with said leg portion to a second position releasing said foot section to an in-line relationship with said leg portion.

2. The powered reclining chair of claim 1 where said leg portion hingedly connects said seat portion.

3. The powered reclining chair of claim 1 where a link member interconnects said control member and said seat portion.

4. The powered reclining chair of claim 1 where said foot section includes framework on the undersurface thereof mounting roller means which said control member selectively engages during foot section movement from said second position to said first position.

* * * * *